US006773279B2

(12) United States Patent
Yamashita

(10) Patent No.: US 6,773,279 B2
(45) Date of Patent: Aug. 10, 2004

(54) LEVER-TYPE CONNECTOR, A LEVER-TYPE CONNECTOR ASSEMBLY AND A METHOD OF ASSEMBLING A LEVER-TYPE CONNECTOR WITH A MATING CONNECTOR

(75) Inventor: Kazunori Yamashita, Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 0 days.

(21) Appl. No.: 10/290,434

(22) Filed: Nov. 7, 2002

(65) Prior Publication Data

US 2003/0109155 A1 Jun. 12, 2003

(30) Foreign Application Priority Data

Dec. 11, 2001 (JP) ..... 2001-346233

(51) Int. Cl.[7] ..... H01R 13/62
(52) U.S. Cl. ..... 439/157
(58) Field of Search ..... 439/157

(56) References Cited

U.S. PATENT DOCUMENTS 5,330,411 A 7/1994 Fujitani et al. ..... 439/157
5,672,068 A * 9/1997 Tsuchiya et al. ..... 439/157

* cited by examiner

*Primary Examiner*—Javaid H. Nasri
(74) *Attorney, Agent, or Firm*—Gerald E. Hespos; Anthony J. Casella

(57) ABSTRACT

A first connector (20) has a lever (70) that is rotatable in a rotation direction (RD) from an initial position to a connecting position. The lever (70) displays a cam action for urging the first connector (20) into connection with a second connector (10). The first connector (20) also has a detector (80) that is moveable in a moving direction (MD) from a standby position to a detecting position. The moving direction (MD) is aligned at an angle to the rotating direction (RD). The lever (70) and the detector (80) are configured so that the lever (70) interferes with the detector (80) and prevents the detector (80) from moving to the detecting position until the lever (70) is in the connecting position. Thus the detector (80) confirms that the lever (70) is in the connecting position.

16 Claims, 11 Drawing Sheets

LEVER-TYPE CONNECTOR, A LEVER-TYPE CONNECTOR ASSEMBLY AND A METHOD OF ASSEMBLING A LEVER-TYPE CONNECTOR WITH A MATING CONNECTOR

BACKGROUND OF THE INVENTION

1. Field of the Invention

The invention relates to a lever-type connector and a method of assembling a lever-type connector with a mating connector.

2. Description of the Related Art

U.S. Pat. No. 5,330,411 discloses a lever-type connector assembly. This assembly has a lever rotatably supported on a first connector and a second connector with a cam pin that is engageable with a cam groove of the lever. The two connectors are lightly fitted to each other with the cam groove and the cam pin engaged. The lever then is rotated and the two connectors are pulled toward each other and connected by the cam action of the cam groove and the cam pin.

A certain operation force is required to rotate the lever in the above-described connector. Thus, an operator may end the rotation without completely rotating the lever to a proper connection position. Hence, the two connectors may be left partly connected. Partial connection can be detected easily by eye if the rotated position of the lever is far from the proper connection position. However, it is difficult to detect a partial connection position by eye if the lever is close to the proper connection position.

The present invention was developed in view of the above problem and an object thereof is to detect the rotated position of a lever.

SUMMARY OF THE INVENTION

The invention is directed to a lever-type connector that has a rotatably mounted lever. A cam action is displayed between the lever on the first connector and a second connector as the lever is rotated from an initial position to a connection position for connecting the connectors. A detector is mountable in or on the first connector and is movable at an angle to the rotating direction of the lever between a standby position and a detecting position. The lever restricts movement of the detector from the standby position towards the detecting position until the lever reaches the connection position. However, the detector does not interfere with the lever and can move to the detecting position when the lever reaches the connection position.

The lever that is rotated to the connection position is retracted from the front side of the detector when the detector is at the standby position. Therefore, the detector is free from interference with the lever and can be moved to the detecting position. On the other hand, the lever that has not reached the connection position is at the front side of the detector when the detector is at the standby position. Thus, the detector and the lever interfere and the detector cannot move to the detecting position. Accordingly, the partly connected state of the connectors and an incomplete rotation of the lever can be detected easily based on whether the detector can be moved to the detecting position.

The moving direction of the detector preferably is substantially normal to the rotating direction of the lever. Therefore, the detector will not interfere with the lever that is retracted from front side of the detector with respect to a moving direction of the detector.

The detector preferably is mounted at a mounting portion flush with or more inward than an outer surface of the first connector. Thus, the detector does not bulge from the outer surface of the first connector, and the first connector has a streamlined outer form.

The front surface of the detector with respect to the moving direction thereof preferably is substantially flush with or more inward than an outer surface of the lever when the detector reaches the detecting position. Thus, the detector does not bulge from the outer surface of the lever when the detector is at the detecting position, and the lever-type connector assembly can have a simple outer shape.

Preferably, the lever has a recess. The detector may avoid interference with the lever at the connection position by being at least partly inserted into the recess in the lever in a corresponding azimuthal position.

The detector preferably is configured to hinder rotation of the lever towards the initial position when the detector is in the detecting position.

Lock means preferably are provided for locking the detector at the standby position and/or the detecting position.

The invention also relates to a connector assembly comprising the above-described lever-type connector and a mating connector.

The invention further relates to a method of assembling a lever-type connector with a mating connector. The method comprises providing a lever-type connector with a rotatable lever and positioning the lever at an initial position. The method continues by partly mating the lever-type connector with a mating connector and rotating the lever from the initial position to a connection position thereby displaying a cam action between the lever and the mating connector for connecting the connector with the mating connector. The method also comprises moving a detector from a standby position on the connector to a detecting position along a moving direction aligned at an angle to a rotating direction of the lever. The detector has its movement towards the detecting position restricted by interference with the lever if the lever is not at the connection position. However, the detector is free from interference with the lever and can move to the detecting position when the lever reaches the connection position.

The method may also comprise the step of mounting the detector such that the front side of the detector with respect to a moving direction of the detector is retracted from the lever.

Preferably, the method also comprises the step of mounting the detector in a mounting portion more inward than an outer surface of the connector at an angle substantially normal to the rotating direction of the lever.

The method also may comprise positioning an outer surface of the mounted detector such that it is located substantially flush with or more inward than the outer surface of the connector.

The method preferably comprises positioning the front surface of the detector with respect to the moving direction thereof such that it is located substantially flush with or more inward than an outer surface of the lever when the detector reaches the detecting position. The detector preferably does not interfere with the lever by being at least partly inserted into a recess in the lever in a corresponding azimuthal position.

The method may comprise employing the detector to hinder rotation of the lever to the initial position when the detector is in the detecting position.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

A lever-type connector assembly according to the invention is illustrated in FIGS. 1 to 11. The assembly has a first connector 20 and a second connector 10 connectable with and separable from each other. In the following description, sides of the two connectors 10, 20 to be connected are referred to as the front, and reference is made to FIGS. 1 to 5 concerning the transverse direction and to FIGS. 1, 6 to 11 concerning the vertical direction.

Figure 2:
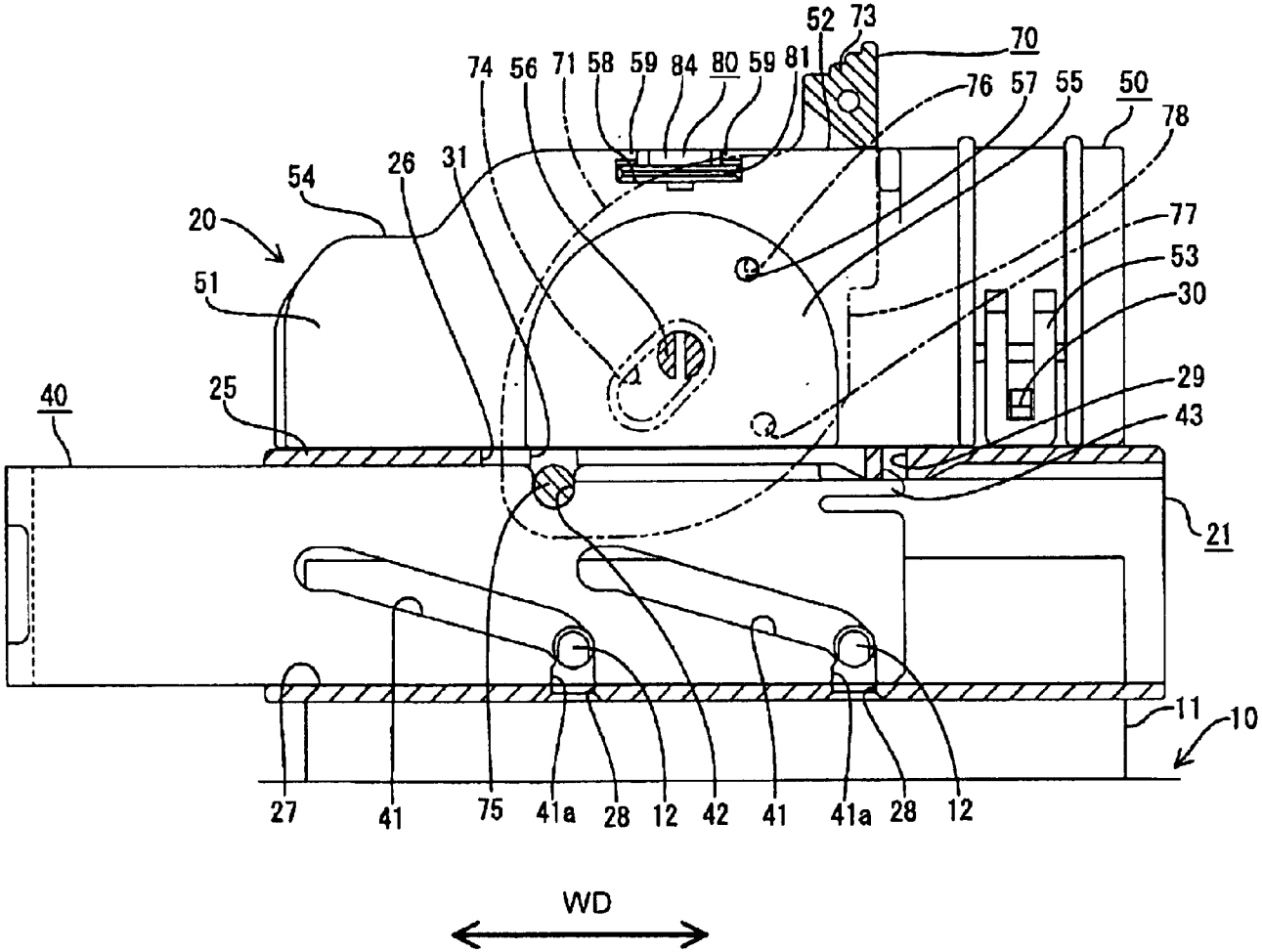
FIG. 2 is a plan view partly in section showing a state where a lever is located at an initial position and cam pins are engaged with cam grooves.
Figure 3:
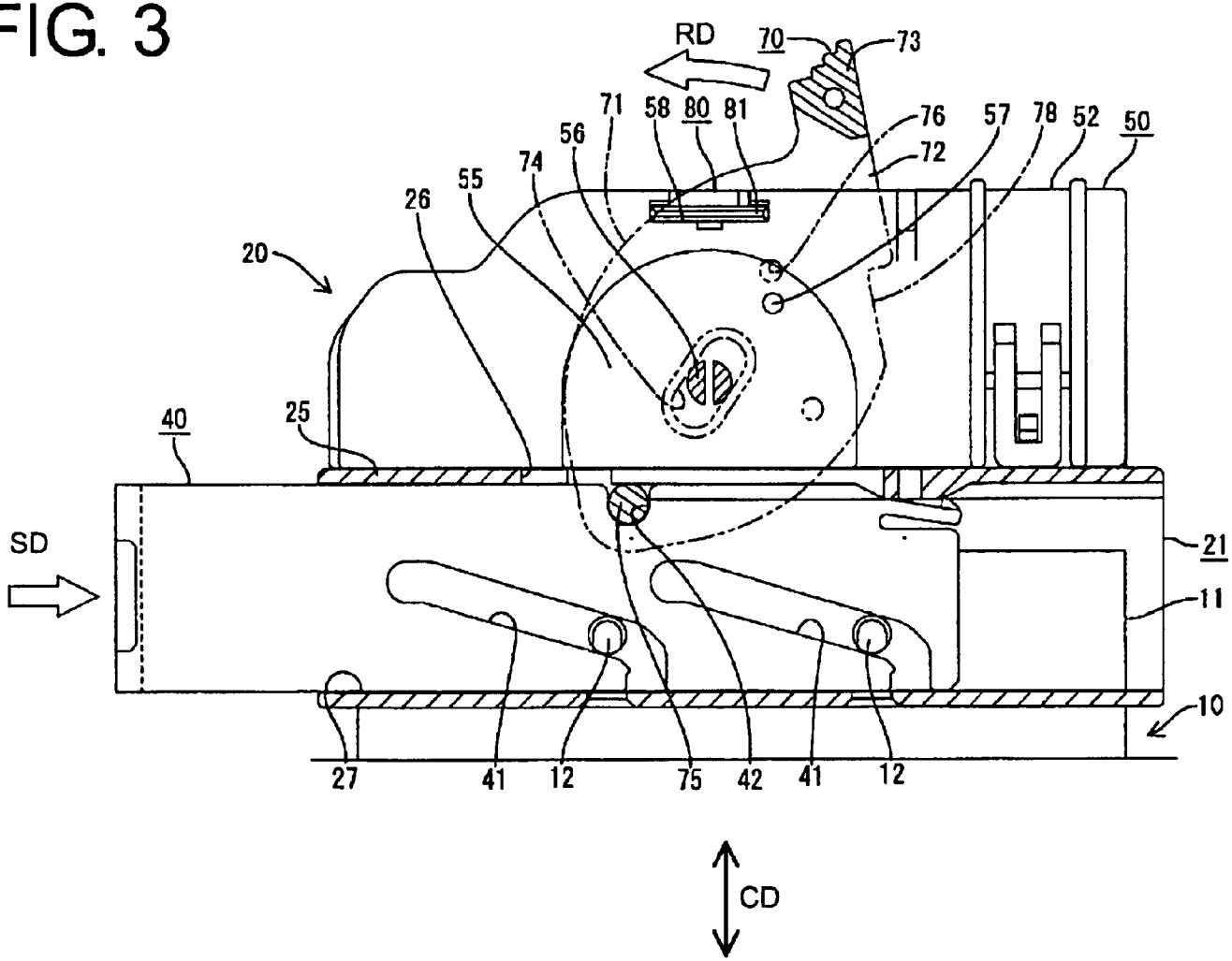
FIG. 3 is a plan view partly in section showing an intermediate stage of rotation of the lever.
Figure 4:
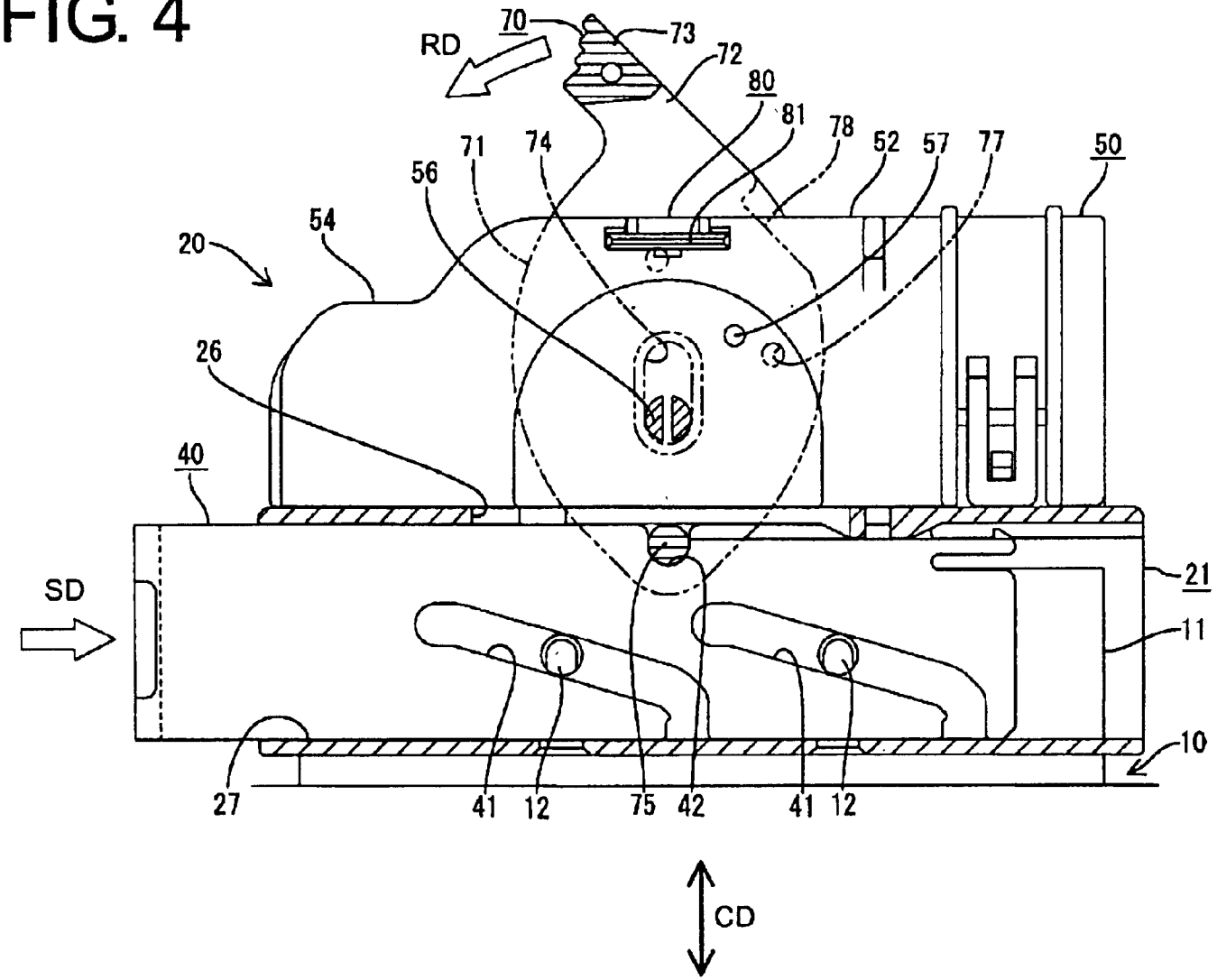
FIG. 4 is a plan view partly in section showing the lever rotated further.

As shown in FIG. 2, the second connector 10 has a forwardly open rectangular tubular receptacle 11 that is fittable into the first connector 20, and terminals (not shown) project into the receptacle 11. Two cylindrical cam pins 12 are formed on the outer surface of each of upper and lower walls of the receptacle 11.

Figure 1:
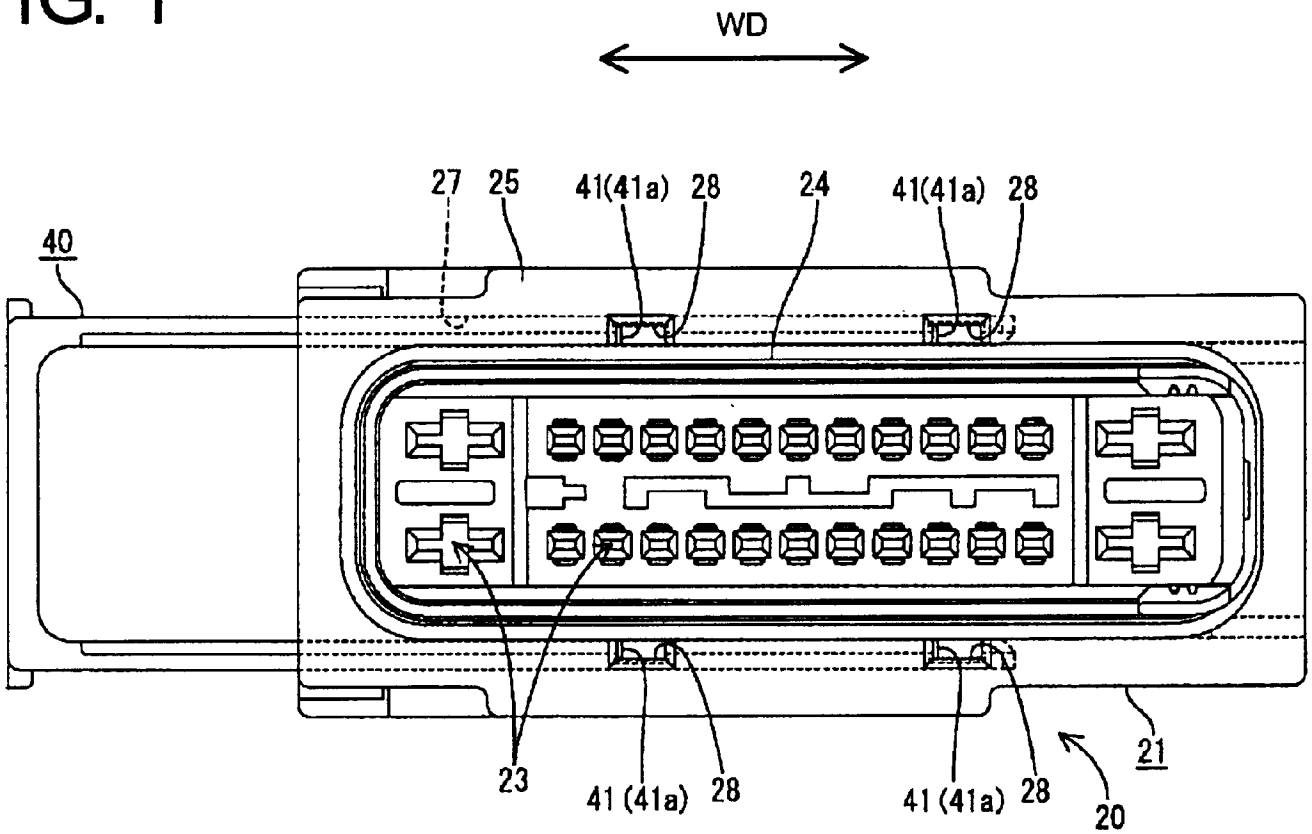
FIG. 1 is a front view of a housing having a slidable member mounted thereon according to one embodiment of the present invention.

The first connector 20, as shown in FIGS. 1 and 2, has a housing 21 for accommodating terminal fittings (not shown) that are electrically connectable with terminals of the second connector 10. A cover 50 is mounted on the housing 21 from behind, which is a side opposite to a mating side with the second connector 10. The housing 21 has cavities 23 in a terminal-accommodating portion 24 for receiving the terminal fittings from behind. An outer tube 25 substantially surrounds the terminal-accommodating portion 24. The receptacle 11 of the second connector 10 is insertable between the terminal-accommodating portion 24 and the outer tube 25 from the front. A lever-accommodating groove 26 of a specified width is formed in the rear surface of the outer tube 25. Slide-accommodating grooves 27 are formed in the opposite side surfaces of the outer tube 25 and extend along the widthwise direction WD. The slide-accommodating grooves 27 communicate with the lever-accommodating groove 26 at an inner side, and the receptacle 11 of the second connector 10 can enter the slide-accommodating grooves 27. Two cam pin-inserting holes 28 are formed at the front end of each of the upper and lower walls of the outer tube 25.

The connector assembly further includes a slide 40 that is U-shaped when viewed from front (FIG. 1). Two cam grooves 41 with open front ends 41*a* are formed in each of the upper and lower laterally long portions of the slide 40. The cam grooves 41 extend obliquely back at an obtuse angle with respect to a sliding direction SD of the slide 40 from the entrances 41*a*, and the cam pins 12 of the second connector 10 are engageable with the cam grooves 41. A resilient locking piece 43 is provided at a rear-right corner of each laterally long portion of the slide 40 and is resiliently deformable along forward and backward directions. The slide 40 can be held at an initial position where the cam grooves 41 substantially align with the corresponding cam pin inserting holes 28 by engaging the resilient locking pieces 43 with locking holes 29 cut into the rear end of the outer tube 25. The slide 40 is linearly slidable from this initial position to the right in the sliding direction SD along the widthwise direction WD, which is substantially normal to connecting directions CD of the connectors 20, 10. Thus, the slide 40 can move to a connection position (see FIG. 5) in the slide-accommodating groove 27 with the cam pins 12 near or at the rear ends of the cam grooves 41.

Figure 6:
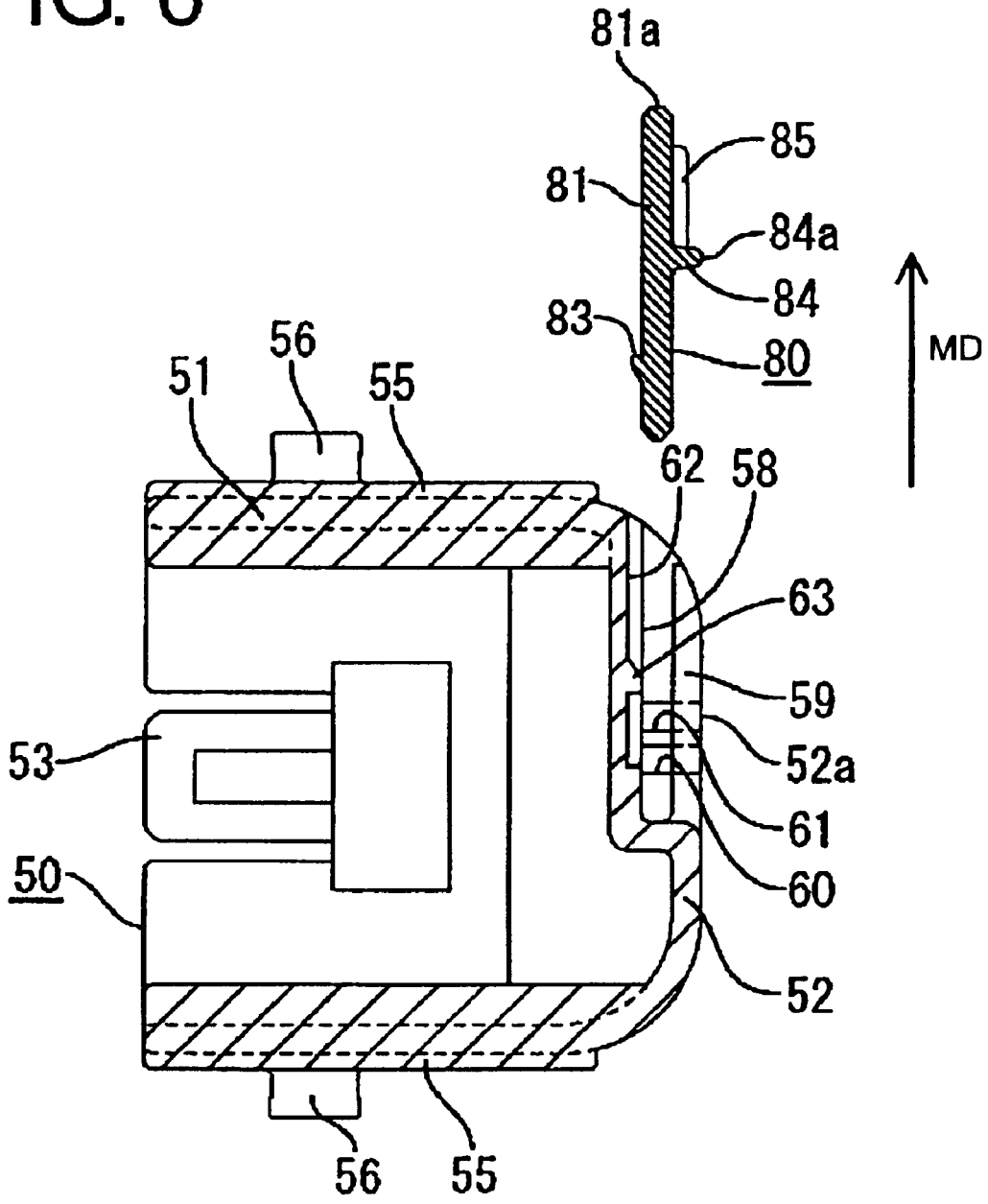
FIG. 6 is a side view in section of a cover and a detecting member.

The cover 50 is substantially in the form of a box having open front and right surfaces. The cover 50 also includes three surrounding walls 51 that surround the upper, bottom and left surfaces of the rear part of the housing 21. The cover 50 further has a rear wall 52 connecting the rear ends of the surrounding walls 51, as shown in FIGS. 2 and 6. Three resilient holding pieces 53 are formed at front-ends of the surrounding walls 51 for engaging holding projections 30 on the side surfaces of the rear part of the housing 21. Thus, the cover 50 can be locked onto the housing 21. Inside the cover 50, wires drawn out through the rear surface of the housing 21 are bent inside the cover 50 substantially normal to the connecting direction CD so that they can be drawn to the outside through an opening laterally made e.g. at the right side of the cover 50. A rear-left side of the cover 50 is recessed to form an escaping portion 54. A center portion of each of the outer surfaces of the upper and lower surrounding walls 51 is slightly raised to form a mounting portion 55 and a substantially cylindrical shaft 56 is formed substantially in the center of each mounting portion 55.

The connector assembly also includes a substantially U-shaped lever 70 with upper and lower substantially plate-shaped arms 71, 72 and an operable portion 73. The lever 70 is supported on the cover 50 for rotation substantially parallel with the widthwise direction WD by engaging oblong holes 74 formed substantially in center positions of the two arms 71, 72 with the shafts 56. A substantially cylindrical projection 75 is formed near the periphery of the inner surface of each arm 71, 72 opposite from the operable portion 73. Further, projection-inserting holes 31 are formed at the rear end of the outer tube 25 for permitting the projections 75 to enter into the slide-accommodating grooves 27 when the lever 70 is inserted into the lever-accommodating groove 26. The oblong holes 74 extend substantially parallel with lines connecting the substantially center positions of the arms 71, 72 and the projections 75.

The lever 70 is rotatable about the shafts 56 between an initial position (see FIG. 2) where the operable portion 73 substantially contacts the rear wall 52 of the cover 50 and the projections 75 are at positions obliquely forward to the left from the oblong holes 74 and a connection position (see FIG. 5) where the operable portion 73 is at least partly in the escaping portion 54 of the cover 50 and the projections 75 are obliquely forward to the right. The oblong holes 74 can be displaced with respect to the shafts 56. Thus, the position of the center of rotation of the lever 70 is movable along the oblong holes 74 as the lever 70 is rotated. A holding projection 57 is provided on each mounting portion 55 obliquely back and to the right from the shaft 56. An initial position holding hole 76 (see FIG. 2) and a connection position holding hole 77 (see FIG. 5) are formed in each arm 71, 72. The initial position holding hole 76 is engageable with the holding projection 57 when the lever 70 is at the initial position and the connection position holding hole 77 is engageable with the holding projection 57 when the lever 70 is at the connection position. Thus, the lever 70 can be held at the initial and connection positions.

The cover 50 is mounted on the housing 21 while the lever 70 is mounted at the initial position. Thus, portions of the outer peripheries of the arms 71, 72 are inserted into the lever-accommodating groove 26. Additionally, the projections 75 are inserted into the slide-accommodating grooves 27 through the projection inserting holes 31 and are engaged with the engaging grooves 42 of the slide 40. Rotary movement of the lever 70 and sliding movement of the slide 40 can be translated into each other by the engagement of the projections 75 and the engaging grooves 42. Accordingly, when the lever 70 is rotated from the initial position (FIG. 2) to the connection position (FIG. 5), the slide 40 is linked and moved from the initial position to the connection position. The two connectors 10, 20 are connected with each other by cam action displayed by the engagement of the cam grooves 41 and the cam pins 12. The projections 75 of the lever 70 and the slide 40 having the cam grooves 41 form a cam means for connecting the two connectors 10, 20 by the cam action.

Figure 7:
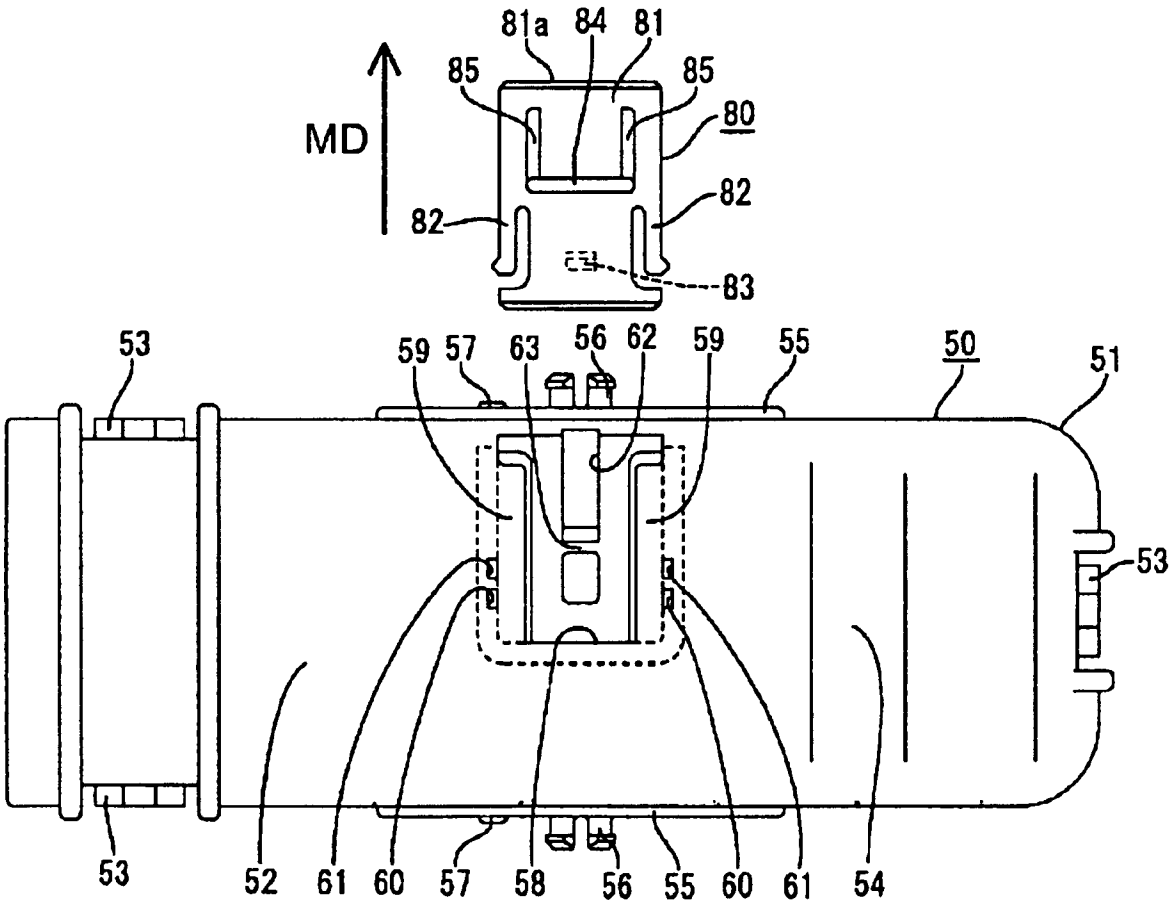
FIG. 7 is a rear view of the cover and the detecting member.

A substantially widthwise middle portion of the rear wall 52 of the cover 50 is partially recessed and forms a mounting recess 58 that opens up and back as shown in FIGS. 6 and 7, and a detector 80 is mountable into this mounting recess 58 from above, which is a direction opposed to the moving direction MD. The mounting recess 58 is more inward than a rear surface 52*a* (outer surface arranged substantially normal to the rotating direction RD or axis of rotation of the lever 70) of the rear wall 52 excluding the mounting recess 58. The detector 80 is movable vertically along the moving direction MD in the mounting recess 58.

The detector 80 has a main body 81 in the form of a substantially flat plate that has a width slightly smaller than the mounting recess 58. The main body 81 is held between the rear surface of the mounting recess 58 and a pair of supporting walls 59 that bulging inward from the rear ends of the side surfaces of the mounting recess 58. Thus, the main body 81 is supported in the mounting recess 58 so as not to shake along forward and backward directions. Two holding arms 82 are formed by L-shaped slits at opposite sides of the main body 81, as shown in FIG. 7. Hence the holding arms are preferably supported at only one end to define cantilevers that are resiliently deformable along widthwise direction WD substantially normal to the moving direction MD of the detector 80. The leading end of each holding arm 82 defines an outwardly projecting hook that can be engaged with a lower standby position holding groove 60 and an upper detecting position holding groove 61 formed in each side surface of the mounting recess 58. Thus, the detector 80 can be held at a lower standby position (see FIGS. 8 and 9) and an upper detecting position (see FIGS. 10 and 11). The holding grooves 60, 61 are open in the rear surface 52*a* of the rear wall 52.

The detector 80, at the standby position, does not interfere with the upper arm 71 of the lever 70 (see FIGS. 8 and 9) since an upper surface 81*a* (front surface with respect to moving direction MD) of the main portion 81 is slightly below the upper surface of the upper mounting portion 55 while the lower surface of the main body 81 is near the bottom surface of the mounting recess 58. Thus, portions of the arm 71 between the operable portion 73 and the oblong hole 74 are constantly above the detector 80 as the lever 70 is rotated from the initial position toward the connection position. Accordingly, if an attempt is made to move the detector 80 up from the standby position, the detector 80 will abut against the lower surface of the arm 71 and have its upward movement restricted. On the other hand, a notch 78 is formed at the right edge of the upper arm 71 in FIG. 2 (rear edge of the arm 71 at the connection position shown in FIG. 5) and extends along the outer shape of the detector 80 (front and left surfaces of the detector 80). The notch 78 aligns with the detector 80 (see FIG. 5) only when the lever 70 reaches a connection position. Thus, when the lever 70 is at the connection position, the arm 71 forces the detector 80 to stay at the standby position. Therefore, the detector 80 does not interfere with the lever 70 at the connection position when the detector 80 is moved up in the moving direction MD. The detector 80 is permitted to move to the detecting position by entering the notch 78. The detector 80, at the detecting position, projects out from the upper surface of the mounting portion 55, and the upper surface 81*a* thereof is below an upper surface 71*a* of the arm 71 by a specified distance (see FIGS. 10 and 11). In this state, a portion of the main body 81 that projects from the mounting portion 55 is near the peripheral surface (surface normal to the rotating direction RD) of the notch 78 of the arm 71, and the contact of this portion with the peripheral surface prevents the rotation of the lever 70 from the connection position to the initial position.

A locking projection 83 is formed substantially at a widthwise center of a bottom part of the front surface of the main body 81, as shown in FIGS. 6 and 7, and is insertable into an escaping groove 62 in the rear surface of the mounting recess 58. A stopper 63 bulges out at an intermediate position of the escaping groove 62 and is spaced above the locking projection 83 along the moving direction MD at the standby position (see FIG. 8). However, the upper surface of the locking projection 83 is engaged with the bottom surface of the stopper 63 to prevent the detector 80 from being withdrawn up in the moving direction MD at the detecting position (see FIG. 10). The bottom surface of the locking projection 83 and the upper surface of the stopper 63 are slanted so that the locking projection 83 can move onto or pass the stopper 63.

An operable projecting plate 84 is provided substantially in the widthwise middle of the rear surface of the main body 81 and is narrow along the widthwise direction WD of the connector 20 or cover 50. The detector 80 can be moved up and down along the moving direction MD by manipulating the operable projecting plate 84. Two guide ribs 85 extend up from the opposite sides of the upper surface of the operable projecting plate 84 and have a height slightly lower than that of the operable projecting plate 84. Up and down movements of the detector 80 along the moving direction MD are guided by bringing the inner side surfaces of the two supporting walls 59 substantially into sliding contact with the outer side surfaces of the operable projecting plate 84 and with the two guide ribs 85. A rear surface 84*a* of the operable projecting plate 84 of the mounted detector 80 is substantially flush with the rear surface 52*a* of the rear wall 52 of the cover 50 excluding the mounting recess 58.

Figure 8:
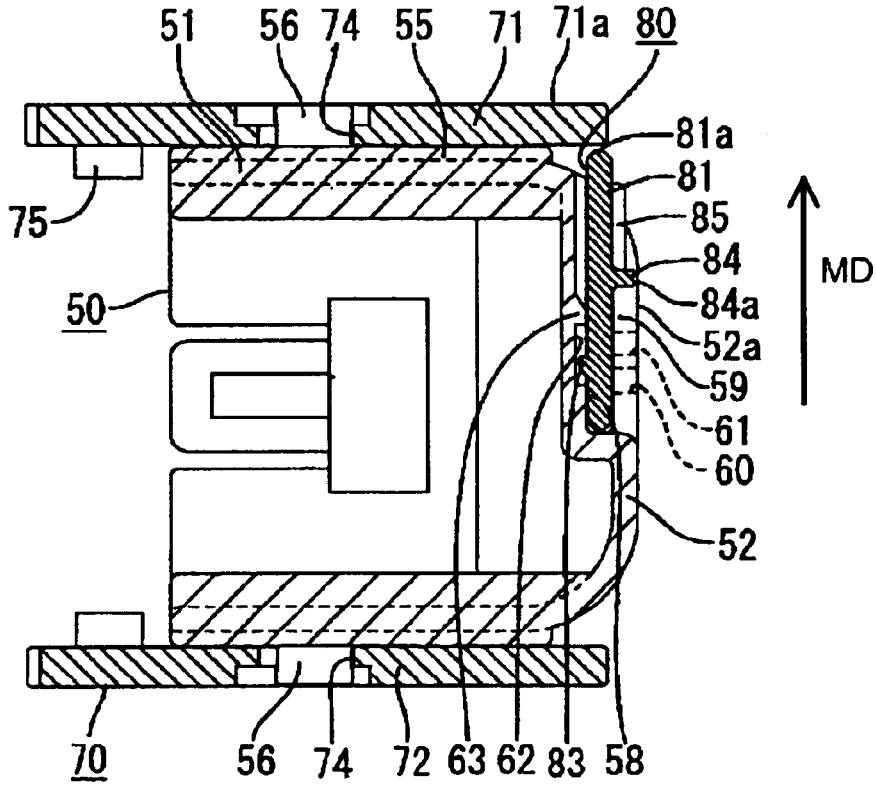
FIG. 8 is a side view in section showing a state where the detector is at a standby position with the lever at the initial position.
Figure 9:
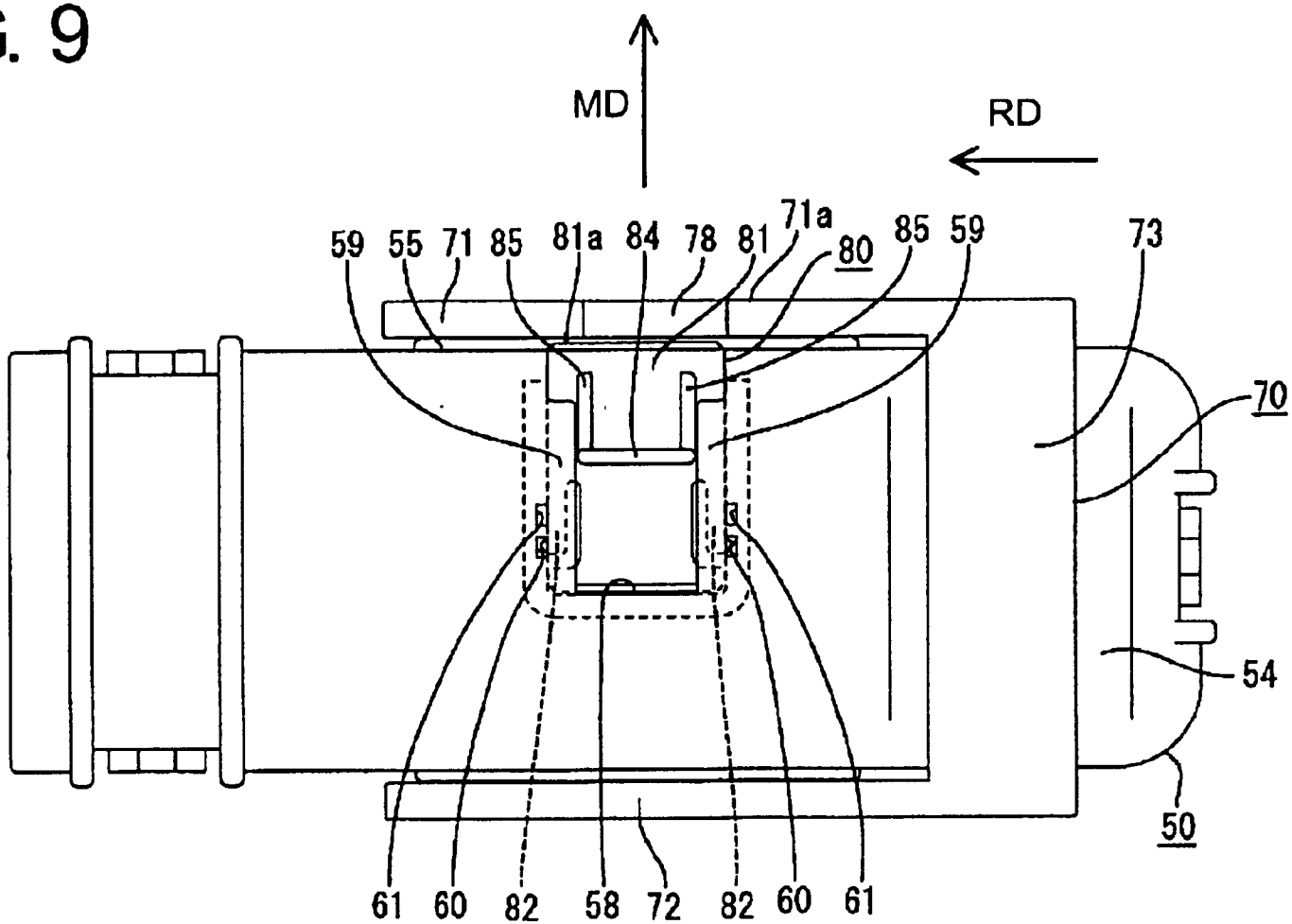
FIG. 9 is a rear view showing a state where the detector is mounted at the standby position with the lever at the connection position.

The first connector 20 is assembled by mounting the lever 70 on the cover 50 with the lever 70 at the initial position. The detector 80 then is mounted at the standby position in the mounting recess 58 of the cover 50. At this time, the arm 71 is above the detector 80, as shown in FIG. 8. Thus, even if a force acts on the detector 80 to move it up in the moving direction MD, the upper surface 81*a* of the main body 81 abuts against the lower surface of the arm 71 and restricts the movement of the detector 80. Accordingly, the detector 80 cannot be moved inadvertently to the detecting position.

Assembly proceeds by mounting the slide 40 at the initial position on the housing 21. The subassembly of the cover 50, the detector 80 and the lever 70 then is mounted from behind onto the subassembly of the housing 21 and the slide 40. Thus, the lever 70 enters the lever-accommodating groove 26 and the projections 75 enter the slide-accommodating grooves 27 and engage the engaging grooves 42 of the slide 40 (see FIG. 2).

The connectors 10, 20 are connected by lightly fitting the second connector 10 into the first connector 20 so that the cam pins 12 enter the entrances 41*a* of the cam grooves 41 through the cam pin inserting holes 28, as shown in FIG. 2. The lever 70 then is rotated in the rotation direction RD toward the connection position by displacing the operable portion 73 in the rotation direction RD. This rotation causes the projections 75 to push the inner walls of the engaging grooves 42 in the sliding direction SD. Thus, the slide 40 is slid in the sliding direction SD toward the connection position while being linked with the lever 70. A cam effect is displayed by the engagement of the cam grooves 41 and the cam pins 12 as the slide 40 is moved in the sliding direction SD. As a result, the second connector 10 is pulled in the connecting direction CD and toward the first connector 20. In this process, the projections 75 move linearly along the widthwise direction WD or slidable direction SD together with the slide 40 since the center of rotation of the lever 70 itself moves along the oblong holes 74 by the relative displacement of the oblong holes 74 with respect to the shafts 56.

The detector 80 is still at the standby position and is constantly below the arm 71 during the rotation of the lever 70. An operator could mistakenly believe the lever 70 has reached the connection position, and could try to move the detector 80 even though the lever 70 is immediately before the connection position. However, the main body 81 will abut against the arm 71 and have its movement restricted. As a result, partial connection of the two connectors 10, 20 can be detected.

Figure 5:
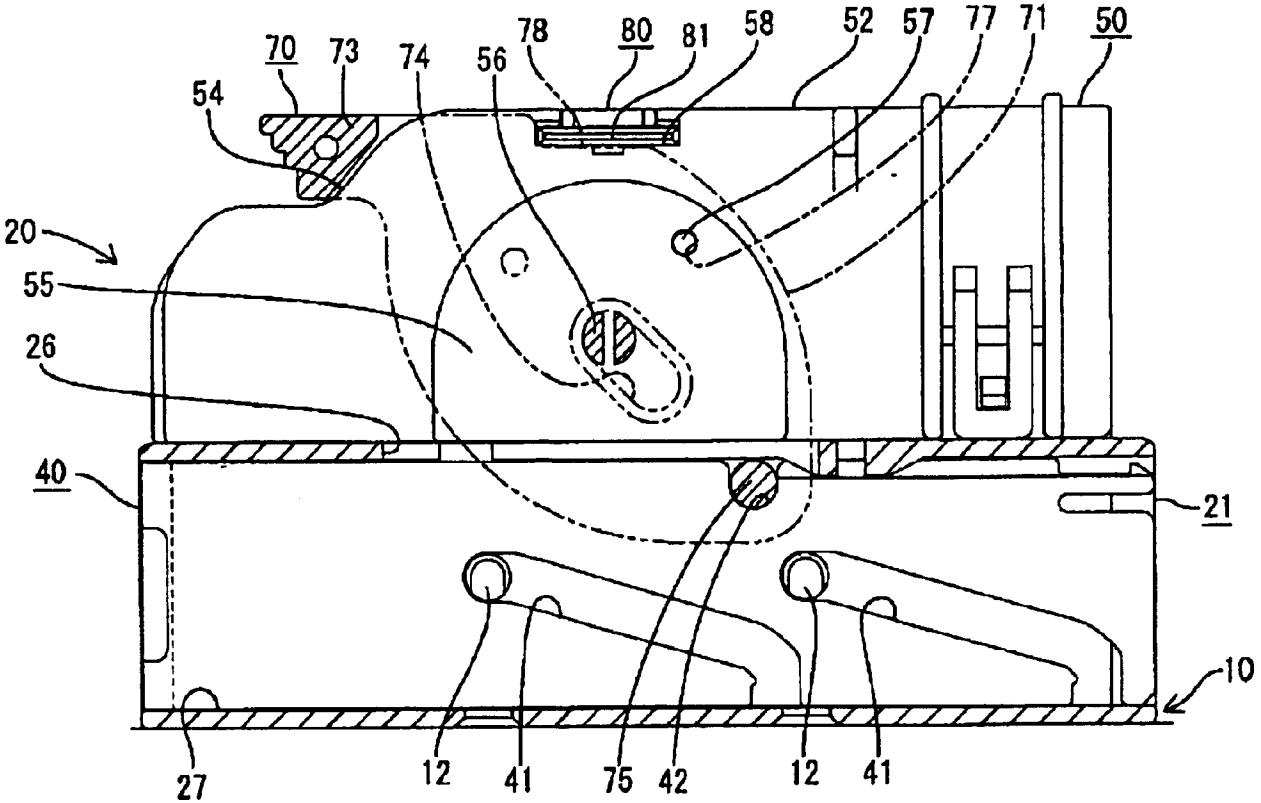
FIG. 5 is a plan view partly in section showing a state where the lever reaches a connection position to connect two connectors.

The lever 70 eventually reaches the connection position. At this time, the slide 40 also reaches the connection position and the cam pins 12 are at the rear ends of the cam grooves 4, as shown in FIG. 5. In this way, the two connectors 10, 20 are connected to a proper depth. These relative positions substantially align the detector 80 with the notch 78. Hence the arm 71 is no longer above the detector 80 and no longer hinders movement of the detector 80 in the moving direction MD. It should be noted that the slidable member 40 may be operated instead of the lever 70 during the connecting operation. In such a case, the cam effect between the cam grooves 41 and the cam pins 12 can be achieved by pushing the slide 40 in the sliding direction SD toward the detecting position. Movement of the slide 40 in the sliding direction SD causes the inner walls of the engaging grooves 42 to push the projections 75 to the right. Thus the lever 70 is rotated from the initial position to the connection position while being linked with the slide 40.

Figure 10:
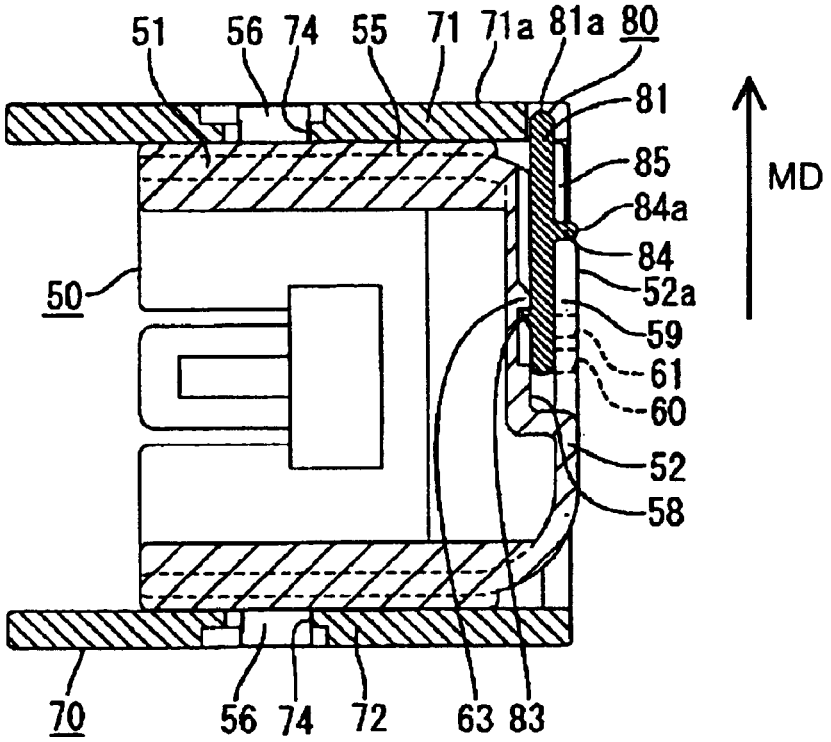
FIG. 10 is a side view in section showing the detector moved to a detecting position with the lever located at the connection position.
Figure 11:
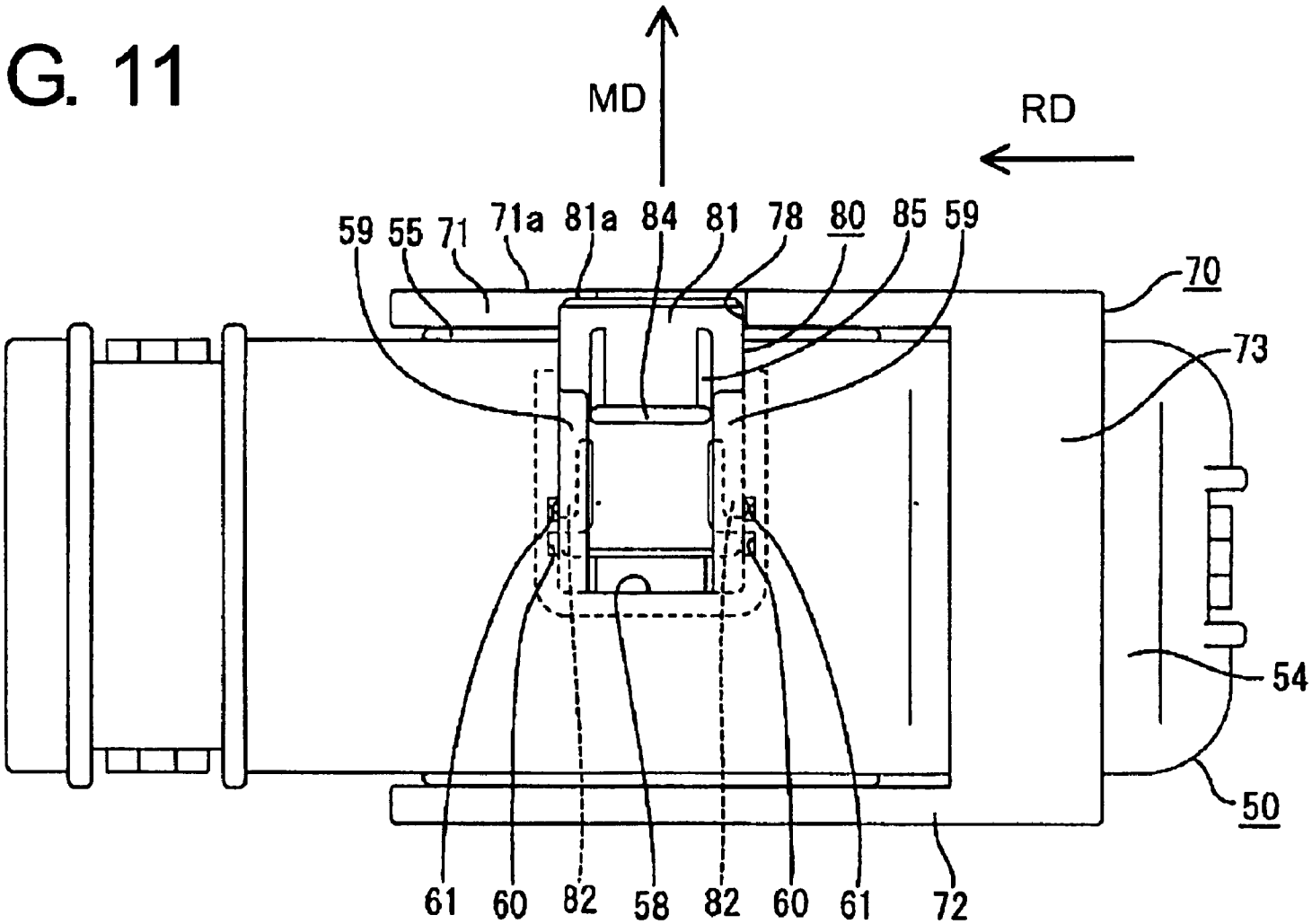
FIG. 11 is a rear view showing the detector mounted at the detecting position with the lever at the connection position.

The detector 80 is moved after the lever 70 is rotated completely. Specifically, the operable projecting plate 84 of the detector 80 is pushed up in the moving direction MD. The main body 81 now is free from interference of the arm 71 and projects up from the mounting portion 55 into the notch 78. Thus, the detector 80 reaches the detecting position, as shown in FIGS. 10 and 11. At this stage, the upper surface 81*a* of the main body 81 is below the upper surface 71 a of the arm 71 and the locking projection 83 contacts the stopper 63 to prevent the detector 80 from being withdrawn up from the detecting position. Rotation of the lever 70 to the connection position and proper connection of the connectors 10, 20 can be detected based on whether the detector 80 can be moved to the detecting position. At this time, the operator can easily see the vertical position of the detector 80 from behind. At the detecting position, the portion of the main body 81 that projects up from the mounting portion 55 is near the peripheral surface of the notch 78. An inadvertent force conceivably could rotate the lever 70 from the connection position to the initial position. However, the lever 70 is prevented from rotating both by the engagement of the holding projections 57 with the connection position holding holes 77 and the contact of the peripheral surface of the notch 78 with the projecting portion of the main body 81 along the rotating direction of the lever 70. Therefore, the two connectors 10, 20 are held firmly in a properly connected condition. To separate the connectors 10, 20, the detector 80 is moved down from the detecting position to the standby position, and the lever 70 is rotated from the connection position to the initial position.

As described above, the movement of the detector 80 is restricted the arm 71 until the lever 70 reaches the connection position. When the lever 70 reaches the connection position, the arm 71 does not interfere with the detector 70 and the detector 80 can move. Thus, the rotated position of the lever 70 and the connected state of the connectors 10, 20 is detected easily based on whether the detector 80 can move to the detecting position.

The detector 80 is accommodated in the mounting recess 58 in the rear wall 52 of the cover 50, and the rearmost surface of the detector 80 is substantially flush with portions of the rear surface 52*a* of the rear wall 52 spaced from the mounting recess 58. Thus, the detector 80 does not bulge out from the cover 50, and the cover 50 has a streamlined outer shape.

The upper surface 81*a* of the detector 80 at the detecting position is below the upper surface 71*a* of the arm 71 of the lever 70. Thus, the detector 80 does not bulge out from the lever 70, and the lever has a streamlined outer shape.

The wires drawn out through the rear surface of the housing 21 are bent in the cover 50 and drawn out to the right side of the cover 50, and the detector 80 is mounted in the rear wall of the cover 50. Thus, the wires are not a hindrance when the detector 80 is operated, and the position of the detector 80 can be seen easily.

The invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

In the foregoing embodiment, the slide having the cam grooves is between the lever and the second connector, and the lever is operated to move the slide by the projections of the lever, thereby displaying the cam action. However, the slide and the projections may be omitted, and the lever may be formed with cam grooves and the cam pins of the second connectors are directly pulled by the lever in accordance the present invention.

Although the notch for escaping the detector is in the arm of the lever in the foregoing embodiment, it may be omitted, for example, if the position of the mounting recess is changed and the detector does not interfere with the arm only when the lever is at the connection position.

Although the rear surface of the operable projecting plate and the rear surface of the rear wall of the cover are substantially flush with each other in the foregoing embodiment, the rear surface of the operable projecting plate may be located more inward than the rear surface of the rear wall according to the present invention. When the detector is at the detecting position, the upper surface of the main body and the upper surface of the arm are substantially aligned and substantially flush with each other according to the invention.

Although the mounting recess is in the rear wall of the cover in the foregoing embodiment, it may be provided in the surrounding wall of the cover.

Instead of being mounted on the cover, the lever may be mounted on the housing according to the present invention. In an embodiment in which the cover is omitted and the lever is mounted on the housing, the mounting recess may be provided in an outer wall of the housing. Such an embodiment is also embraced by the present invention.

What is claimed is:

1. A lever-type connector comprising a lever rotatable about a rotational axis and in a rotating direction between an initial position and a connection position and being configured for displaying a cam action with a mating connector as the lever is rotated for connecting the connector with the mating connector, a detector mounted on the connector and movable along a moving direction between a standby position and a detecting position, the moving direction being aligned at an angle to the rotating direction of the lever and substantially parallel to the rotational axis of the lever, the lever and the detector being configured such that movement of the detector to the detecting position is restricted by the lever at all positions of the lever between the initial position and a position immediately before the lever reaches the connection position, and the detector being free from the interference with the lever and moveable to the detection position when the lever reaches the connection position, whereby movement of the detector to the detecting position confirms that the lever has reached the connection position, thereby indicating connecting the connector with the mating connector.

2. The lever-type connector of claim 1, wherein the detector has a front side with respect to a moving direction of the detector, the front side of the detector being free from interference with the lever when the detector is in the standby position.

3. The lever-type connector of claim 1, wherein the connector has an outer surface aligned substantially parallel to the rotational axis of the lever, and wherein the detector is mounted in a mounting portion more inward than the outer surface of the connector.

4. The lever-type connector of claim 1, wherein an outer surface of the detector is substantially flush with or more inward than the outer surface of the connector.

5. The lever-type connector of claim 1, wherein a front surface of the detector with respect to the moving direction thereof is located substantially flush with or more inward than an outer surface of the lever when the detector reaches the detecting position.

6. A connector assembly comprising a lever-type connector according to claim 1 and a mating connector to be mated therewith.

7. The lever-type connector of claim 1, wherein the detector hinders the rotation of the lever towards the initial position when the detector is in the detecting position.

8. The lever-type connector of claim 7, wherein lock means are provided for locking the detector at the standby position and the detecting position.

9. A lever-type connector, comprising a lever rotatable in a rotating direction between an initial position and a connection position and being configured for displaying a cam action with a mating connector as the lever is rotated for connecting the connector with the mating connector, a detector mounted on the connector and movable along a moving direction between a standby position and a detecting position, the moving direction being aligned at an angle to the rotating direction of the lever, the lever and the detector being configured such that movement of the detector to the detecting position is restricted by the lever for all positions between the initial position and a position immediately before the lever reaches the connection position, and wherein the detector is at least partly inserted into a recess provided in the lever in a corresponding azimuthal position to avoid interference with the lever at the connection position, such that the detector is movable to the detection position when the lever reaches the connection position for confirming that the lever is at the connection position and that the connector is connected with the mating connector.

10. A method of assembling a lever-type connector with a mating connector, comprising the following steps:

providing a lever in the lever-type connector and rotatably positioning the lever at an initial position;

partly mating the lever-type connector with the mating connector;

rotating the lever about a rotational axis and in a rotating direction from the initial position to a connection position for displaying a cam action between the lever and the mating connector as the lever is rotated, thereby connecting the connector with the mating connector; and moving a detector on the connector along a moving direction from a standby position to a detecting position, the moving direction being parallel to the rotational axis and at an angle to the rotating direction of the lever, whereby the lever interferes with movement of the detector to the detecting position at all positions of the lever between the initial position and a position immediately before the lever reaches the connection position, and whereby the detector is free from the interference with the lever and is moveable to the detecting position when the lever reaches the connection position.

11. The method of claim 10, further comprising mounting the detector such that a front side of the detector with respect to a moving direction of the detector is free from the interference with the lever.

12. The method of claim 10, wherein the connector has an outer surface aligned substantially parallel to the rotational axis of the lever, the method further comprising mounting the detector in a mounting portion more inward than the outer surface of the connector.

13. The method of claim 12, further comprising positioning an outer surface of the mounted detector substantially flush with or more inward than the outer surface of the connector.

14. The method of claim 10, further comprising positioning a front surface of the detector with respect to the moving direction thereof such that it is substantially flush with or more inward than an outer surface of the lever when the detector reaches the detecting position.

15. The method of claim 14, wherein the detector is inserted into a recess in the lever in a corresponding azimuthal position such that the detector does not interfere with the lever positioned at the connection position.

16. The method of claim 15, wherein the detector hinders the rotation of the lever towards the initial position when the detector is in the detecting position.

* * * * *